US005537960A

United States Patent [19]

Izuo et al.

[11] Patent Number: 5,537,960

[45] Date of Patent: Jul. 23, 1996

[54] VALVE DRIVING APPARATUS DRIVING A VALVE APPARATUS AT A HIGH VOLTAGE BY CONNECTING TWO POWER SOURCES IN SERIES

[75] Inventors: Takashi Izuo, Toyota; Iwao Maeda, Susono, both of Japan

[73] Assignee: Toyota Jidosha Kabushiki Kaisha, Aichi-Ken, Japan

[21] Appl. No.: 418,345

[22] Filed: Apr. 7, 1995

[30] Foreign Application Priority Data

Apr. 25, 1994 [JP] Japan ..... 6-086641

[51] Int. Cl.[6] ..... F01L 9/04

[52] U.S. Cl. ..... 123/90.11; 251/129.01

[58] Field of Search ..... 123/90.11; 251/129.01

[56] References Cited

U.S. PATENT DOCUMENTS

| | | | |
|---|---|---|---|
| 4,176,624 | 12/1979 | Bielecki et al. | 123/90.11 |
| 4,719,882 | 1/1988 | Kreuter | 123/90.11 |
| 4,754,730 | 7/1988 | Campagna | 123/179.3 |

FOREIGN PATENT DOCUMENTS

| | | |
|---|---|---|
| 63-227810 | 11/1988 | Japan . |
| 1-227808 | 9/1989 | Japan . |
| 4-261343 | 9/1992 | Japan . |

*Primary Examiner*—Weilun Lo
*Attorney, Agent, or Firm*—Kenyon & Kenyon

[57] ABSTRACT

A valve driving apparatus has a second electric power source in addition to a main electric power source used in an internal combustion engine. The additional electric power source can be connected in series to the main electric power source so as to supply a high voltage to a solenoid used in the valve driving apparatus. The valve driving apparatus has an electromagnetic linear actuator for reciprocating a valve body of the electromagnetic valve apparatus so as to open or close the electromagnetic valve apparatus. The additional electric power source is provided separately from the main power source. A power source switching unit switches a voltage supplied to the electromagnetic linear actuator between the high voltage and a low voltage. The high voltage is generated by connecting the main electrical power source and the additional electric power source in series. The low voltage is generated by either one of the first electric power source and the second electric power source.

26 Claims, 6 Drawing Sheets

VALVE DRIVING APPARATUS DRIVING A VALVE APPARATUS AT A HIGH VOLTAGE BY CONNECTING TWO POWER SOURCES IN SERIES

BACKGROUND OF THE INVENTION

1. Field of the Invention

The present invention generally relates to valve driving apparatuses used for an internal combustion engine, and more particularly to a valve driving apparatus having an electromagnetic linear actuator which drives a valve body by generating a magnetic force corresponding to a current supplied thereto.

2. Description of the Related Art

An electromagnetically driven valve apparatus is known in which a valve body of a suction or exhaust valve of an internal combustion engine is driven by an electromagnetic attraction force generated by a solenoid. Such a valve apparatus can eliminate the need for a cam mechanism for driving a valve body which had been generally used in the prior art. Additionally, an opening and closing timing of the valve body can be arbitrarily changed, and thus an ideal opening and closing timing determined in response to operating conditions of the internal combustion engine can be realized.

In order to ensure good responsiveness of the electromagnetically driven valve apparatus, it is effective to generate a high-intensity magnetic field by supplying a large current to the solenoid.

On the other hand, an attracting force exerted on the valve body by the magnetic field generated by the solenoid is not only dependent on the intensity of the magnetic field, but is also dependent on a position of the valve body relative to the solenoid. That is, a greater attracting force is exerted on the valve body as the valve body moves inside the solenoid due to reluctance of the magnetic circuit formed around the valve body is decreased.

Accordingly, the generation of only a small magnetic field is sufficient to maintain the valve body at the end of the stroke of the valve body. That is, supplying relatively small current to the solenoid is sufficient to maintain the valve body at the end of the stroke. Therefore, in order to reduce power consumption, it is preferable not to supply a large current to the solenoid.

Japanese Patent Application No. 5-318672 suggests a valve apparatus in which a large current is supplied to a solenoid during an initial stage of a stroke of a valve body and excessive current is suppressed at the end of the stroke. This valve apparatus uses a discharge of a capacitor which is charged by a high voltage generated by means of a DC-DC converter. The high voltage generated by the DC-DC converter is supplied to the solenoid at an initial stage of the stroke which condition enables the valve body to start with good responsiveness. Thereafter, as the valve body moves inside the solenoid, current discharged from the capacitor decreases, and thus power saving can be achieved.

However, in the above-mentioned valve apparatus, the high voltage used for obtaining good responsiveness of the valve is generated by an expensive DC-DC converter. This increases the manufacturing cost of the valve apparatus.

SUMMARY OF THE INVENTION

It is a general object of the present invention to provide an improved and useful valve driving apparatus used for an internal combustion engine which eliminates the above-mentioned problems.

A more specific object of the present invention is to provide a valve driving apparatus in which an additional electric power source, other than a main electric power source used in an internal combustion engine, is provided. The additional electric power source can be connected in series with the main electric power source so as to supply a high voltage to a solenoid used in the valve driving apparatus.

In order to achieve the above-mentioned objects, there is provided according to the present invention, a valve driving apparatus for driving an electromagnetic valve apparatus used in an internal combustion engine having a first electric power source for driving electric/electronic devices provided therein and an alternator for supplying an electric current to the first electric power source, the valve driving apparatus comprising:

an electromagnetic linear actuator for reciprocating a valve body of the electromagnetic valve apparatus so as to open or close the electromagnetic valve apparatus;

a second electric power source separately provided from the first power source; and a power source switching unit for switching a voltage supplied to the electromagnetic linear actuator between a high voltage and a low voltage, the high voltage being generated by connecting the first electrical power source and the second electric power source in series, the low voltage being generated by either one of the first electric power source and the second electric power source.

According to the present invention the second electric power source is connected to the first electric power source in series when a stroke of the valve body is initiated. Thus, a high voltage is supplied to the solenoid to move the valve body toward the end of the stroke. Thereafter, either one of the first electric power source or the second electric power source is disconnected from the solenoid so that the solenoid is driven only by either one of the first electric power source and the second electric power source at a reduced voltage, and therefore power consumed by the solenoid is reduced with a simple construction of the valve driving apparatus.

Other objects, features and advantages of the present invention will become more apparent from the following detailed description when read in conjunction with the accompanying drawings.

DETAILED DESCRIPTION OF THE PREFERRED EMBODIMENT

Figure 1:
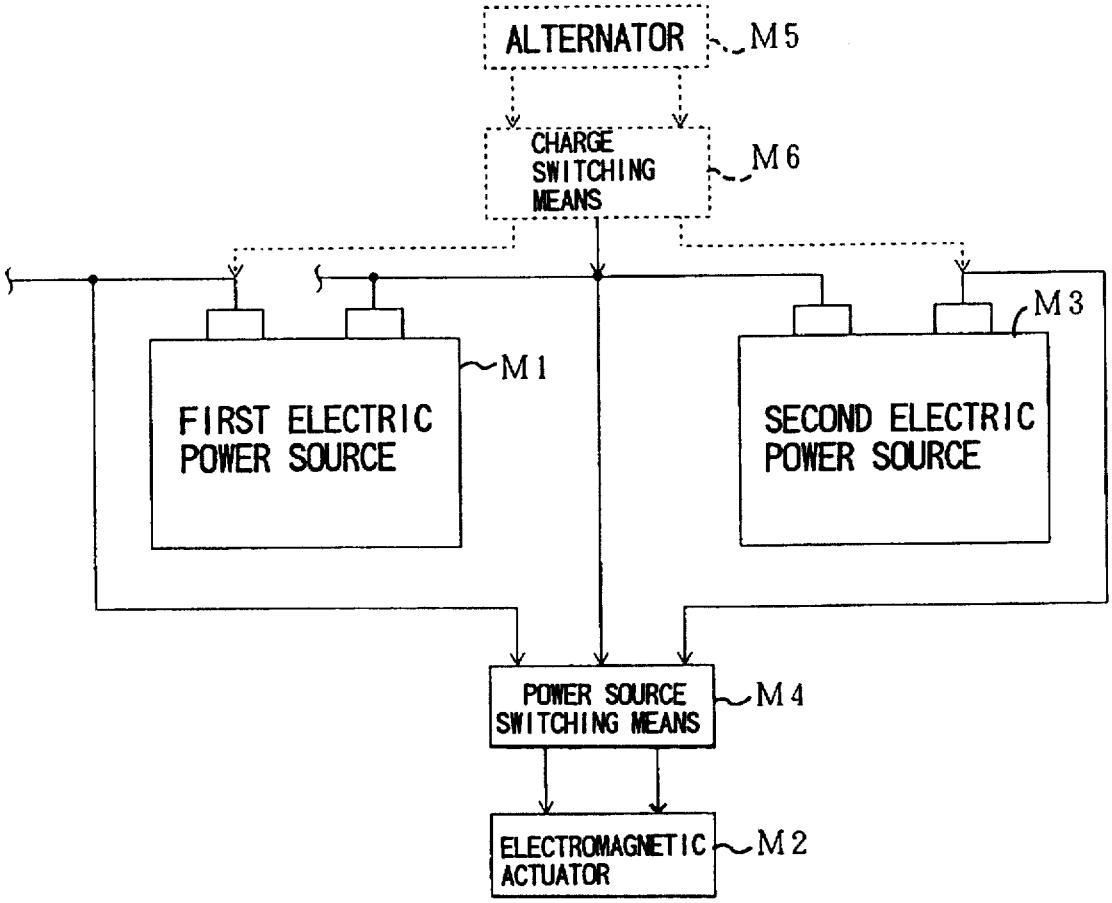
FIG. 1 is a block diagram showing a basic structure of a valve driving apparatus of an embodiment according to the present invention.

A description will now be given, with reference to FIG. 1, of a basic structure of an embodiment according to the present invention. FIG. 1 is a block diagram showing a basic structure of a valve driving apparatus of the embodiment according to the present invention. The valve driving apparatus is generally used for driving a valve apparatus used in an internal combustion engine.

The valve driving apparatus shown in FIG. 1 comprises a first electric power source M1, an electromagnetic linear actuator M2, a second electric power source M3 and power source switching means M4. The first electric power source M1 is commonly used for supplying current to other electric parts provided in the internal combustion engine in which the valve driving apparatus is incorporated. The electromagnetic linear actuator M2 generates an electromagnetic force according to a current supplied thereto so as to open or close the valve apparatus. The second electric power source M3 is separately provided from the first electric power source M1. The power source switching means M4 switches a connection between the electromagnetic linear actuator M2 and the first and second electric power sources M1 and M3 to either a first state in which the first and second electric power sources M1 and M3 are connected in series to the electromagnetic linear actuator M2, or a second state in which either one of the first and second electric power sources M1 and M3 is connected to the electromagnetic linear actuator M2. When the first and second electric power sources M1 and M3 are connected in series to the electromagnetic linear actuator M2, a high voltage is applied to the electromagnetic linear actuator M2 and thus a large electromagnetic force is generated in the actuator M2. When either one of the first and second electric power sources M1 and M3 is connected to the electromagnetic linear actuator M2, a low voltage is applied to the electromagnetic linear actuator M2 and thus a small electromagnetic force is generated in the electromagnetic linear actuator M2.

Additionally, the valve driving apparatus shown in FIG. 1 may comprise charge switching means M6 which selectively switches a connection of an alternator M5, which generates an electric power for charging, to either one of the first and second electric power sources M1 and M3. It should be noted that the alternator M5 is provided originally for charging the first electric power source M1. Accordingly, the charge switching means M6 switches the connection of the alternator M5 from the first electric power source M1 to the second electric power source M3 each time a number of rotations of the internal combustion engine reaches a predetermined value. After the second electric power source M3 is sufficiently charged, the connection of the alternator M5 is switched back to the first electric power source M1. Thus, both of the first and second electric power sources M1 and M3 are maintained in sufficiently charged condition.

Figure 2:
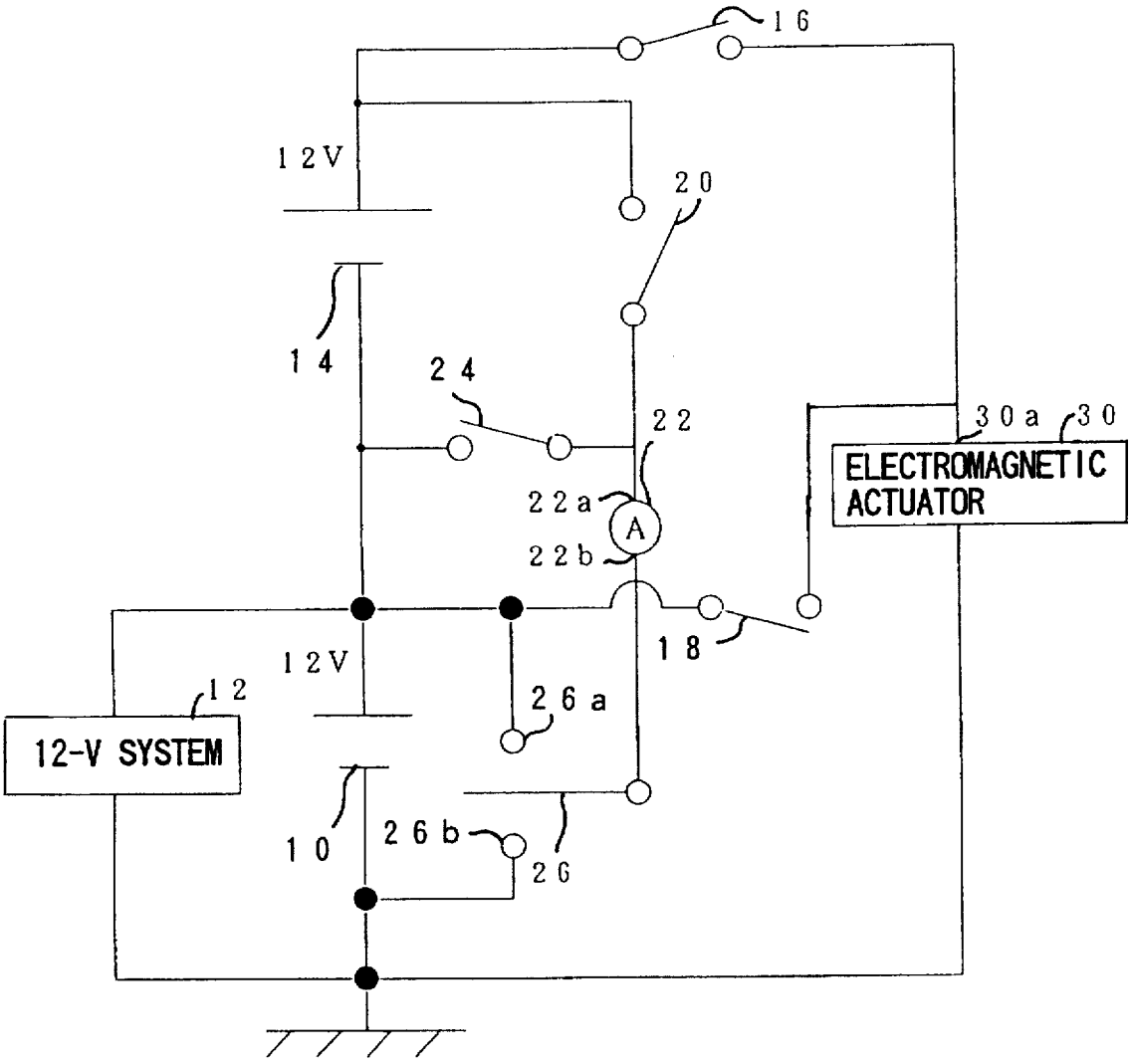
FIG. 2 is a circuit diagram of the valve driving apparatus shown in FIG. 1.

A description will now be given, with reference to FIG. 2, of the embodiment of the valve driving apparatus shown in FIG. 1. FIG. 2 is a circuit diagram of the valve driving apparatus shown in FIG. 1. It should be noted that the valve driving apparatus shown in FIG. 2 is associated with an internal combustion engine in which a 12-V system including various electronic controlling units, sensors and actuators adapted to be used with a 12-V battery is used.

In FIG. 2, a first battery 10 comprising a 12-V rechargeable battery, which corresponds to the first electric power source M1, serves as a regular power source for a 12 V-system 12 in the internal combustion engine. A negative electrode terminal of the battery 10 is grounded together with a ground terminal of the 12-V system 12 and a ground terminal of an electromagnetic linear actuator 30, which corresponds to the electromagnetic linear actuator M2. On the other hand, a positive electrode terminal of the first battery 10 is connected to a negative electrode terminal of a second battery 14, which corresponding to the second electric power source M3.

The second battery 14, comprising a 12-V rechargeable battery, is provided for driving the electromagnetic linear actuator 30. A positive electrode terminal of the second battery 14 is connected to a positive terminal **30*a* of the electromagnetic linear actuator 30 via a first switch 16. That is, the first and second batteries 10 and 14 are connected in series to the electromagnetic linear actuator 30 via the switch 16**.

On the other hand, a positive electrode terminal of the first battery 10 is connected to the positive terminal **30*a* of the electromagnetic linear actuator 30 via a second switch 18. That is, when the second switch 18 is closed, a closed circuit is formed and thus a voltage across the negative and positive electrode terminals of the first battery 10 is applied to the electromagnetic linear actuator 30**.

A positive electrode terminal of the second battery 14 is connected to a positive terminal **22*a* of an alternator 22, which corresponds to the alternator M5, via a third switch 20. The positive terminal 22*a* is connected to the negative electrode terminal of the second battery 14 via a fourth switch 24. On the other hand, a negative terminal 22*b* of the alternator 22 is connected to a fifth switch 26 having two contacts 26*a* and 26*b*. Via the fifth switch 26, the negative terminal 22*b* of the alternator 22 is connected to either one of the negative electrode terminal of the first battery 10 and the negative electrode terminal of the second battery 14. It should be noted that the alternator 22** is a known 12-V generator which generates a DC current by using a driving force of the internal combustion engine.

In the present embodiment, when the fourth switch 24 is closed while the third switch 20 is open and the fifth switch 26 is switched to a contact **26*b* side, the alternator 22 is connected to the first battery 10. On the other hand, when the third switch 20 is closed while the fourth switch 24 is open and the fifth switch 26 is switched to a contact 26*a* side, the alternator 22 is connected to the second battery 14**.

Figure 3:
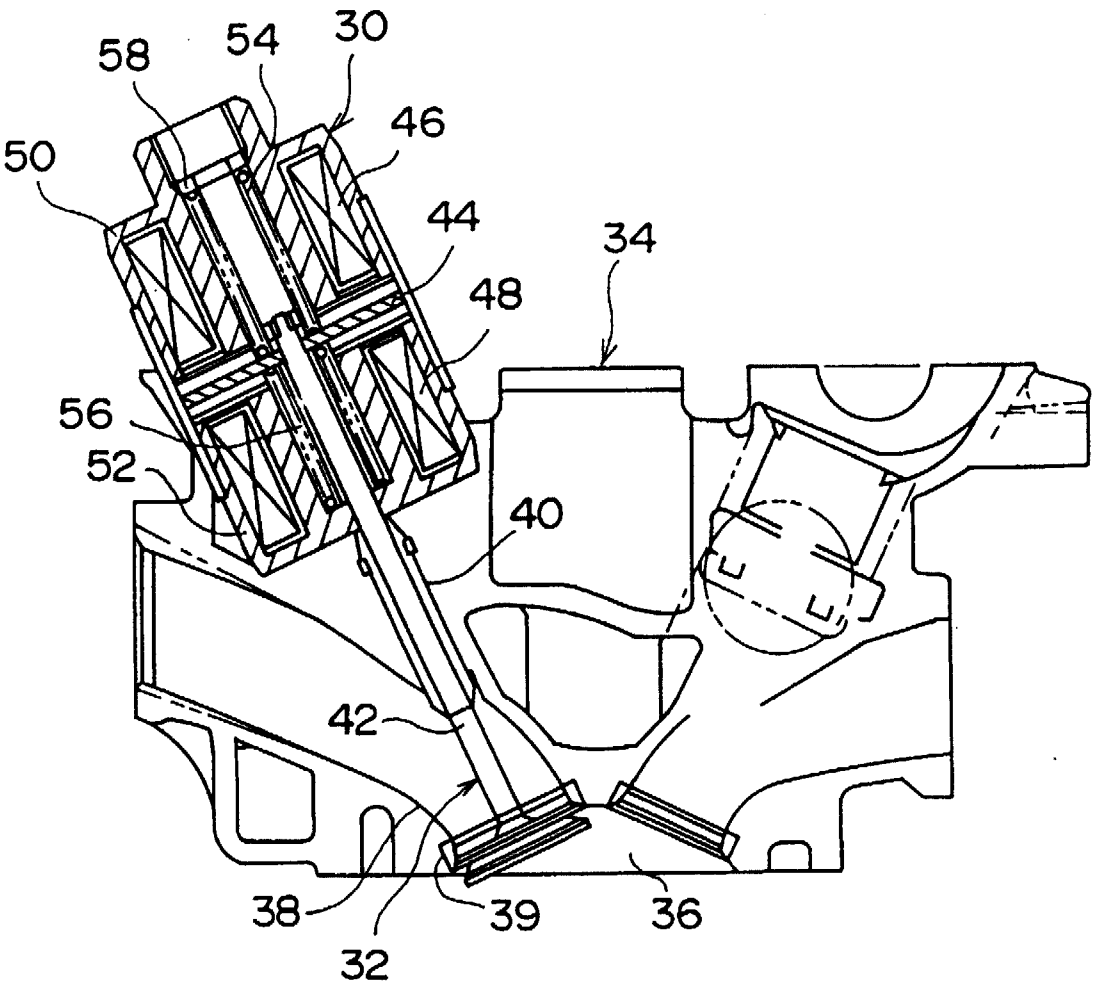
FIG. 3 is a cross-sectional view of an electromagnetic linear actuator used in the valve driving apparatus shown in FIG. 2.

A description will now be given, with reference to FIG. 3, of the electromagnetic valve apparatus which is driven by the above-mentioned valve driving apparatus according to the present invention. FIG. 3 is a cross-sectional view of the electromagnetic linear actuator 30 used in the valve driving apparatus shown in FIG. 2 in a state in which the electromagnetic vale apparatus is assembled to a cylinder head 34 of the internal combustion engine.

In FIG. 3, a valve body 32 is positioned in a port 38 in a state in which one end thereof is disposed inside a combustion chamber 36. A valve seat 39 for the valve body 32 is provided on an end of the port 38 so that the port 38 is opened or closed according to a reciprocal movement of the valve body 32.

The valve body 32 is supported by a rod 42 which reciprocates inside a valve guide 40. A plunger 44 formed of a magnetic material is fixed on an end of the rod 42. The plunger 44 generally has a disk-like shape and is disposed in a space between a first solenoid 46 and a second solenoid 48.

The first solenoid 46 is surrounded by a yoke 50, and the second solenoid 48 is surrounded by a yoke 52. A coil spring 54 is disposed inside the yoke 50, and a coil spring 56 is disposed inside the yoke 52. One end of the coil spring 54 is fixed on a stopper 58 and the other end is fixed to the plunger 44. One end of the coil spring 56 is fixed on the yoke 52 and the other end is fixed to the plunger 44. That is, the plunger 44 is pressed by the coil springs 54 and 56 in opposite directions so that the plunger 44 is positioned at a position in which pressing forces exerted by the coil springs 54 and 56 are balanced. When the plunger 44 is at the balanced position, the valve body is at a neutral position of its stroke.

Since the plunger 44 is formed of a magnetic material, when current is supplied to the first solenoid 46 to generate a magnetic field around the first solenoid 46, the plunger 44 is attracted by the first solenoid 46 and thus moves toward the first solenoid 46. On other hand, when current is supplied to the second solenoid 48 to generate a magnetic field around the second solenoid 48, the plunger 44 is attracted by the second solenoid 48 and thus moves toward the second solenoid 48. Accordingly, if an appropriate current is supplied alternately to the first and second solenoids 46 and 48, the plunger 44 is reciprocated and thereby the valve body 32 fixed to the plunger 44 via the rod 42 is reciprocated. This results in switching between open and closed states of the electromagnetic valve apparatus shown in FIG. 3.

Figure 4:
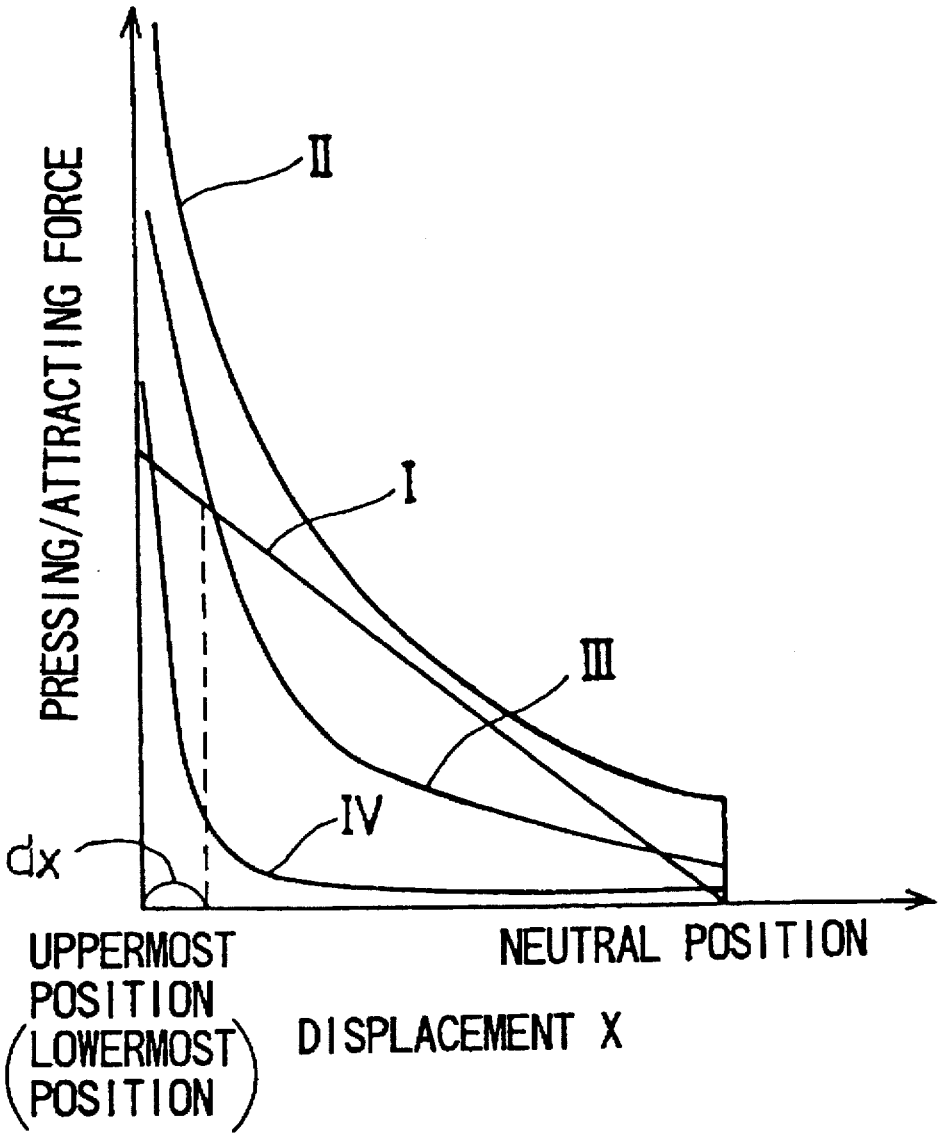
FIG. 4 is a graph showing a characteristic of the electromagnetic linear actuator shown in FIG. 3.

FIG. 4 is a graph showing a characteristic of the electromagnetic linear actuator 30 shown in FIG. 3. The horizontal axis of the graph shown in FIG. 4 represents a displacement x of the plunger 44, and the vertical axis represents a force exerted on the plunger 44. The force exerted on the plunger 44 includes attracting forces generated by the first and second solenoids 46 and 48 and pressing forces generated by the first and second coil springs 54 and 56.

In FIG. 4, a solid line I indicates a pressing force exerted by the first and second coil springs 54 and 56 on the plunger 44. The pressing force exerted on the plunger 44 linearly increases as the plunger 44 moves toward an end of stroke from the neutral position. That is, a pressing force indicated by the solid line I is exerted on the plunger 44 in accordance with a displacement x. In order to move the valve body 32 from the neutral position to an uppermost position by means of the first solenoid 46, at which uppermost position the electromagnetic valve apparatus is closed, and hold it at the uppermost position, the plunger 44 has to be attracted by an attracting force indicated by a solid line II which attracting force must always exceed the pressing force indicated by the solid line I. The same condition occurs when the valve body 32 is moved to a lowermost position by means of the second solenoid 48.

When a current supplied to the first solenoid 46 is cut off while the plunger 44 is at the uppermost position, the plunger 44 tends to move toward the second solenoid according to a free vibration because returning energy is stored in the first coil spring 54. However, because a friction loss generated by the rod 42 and the valve guide 40 is present, the plunger 44 can only be moved to a position which is a distance dx before an opposite end of the stroke as shown in FIG. 4. That is, if the plunger 44 is released from the uppermost position, the plunger 44 cannot reach the lowermost position. It should be noted that the graph of FIG. 4 shows only a half portion, that is, from the neutral position to the uppermost position.

Accordingly, in order to continue free vibration (a movement of the plunger 44 toward the opposite end), the energy lost, equivalent to an energy loss such as from mechanical loss generated by friction, must be supplied to the plunger 44 by exerting an attracting force generated by the second solenoid 48. In this case, an attracting force indicated by solid line III in FIG. 4 is sufficient for moving the plunger 44 down to the lowermost position. This attracting force can be smaller than the attracting force indicated by the solid line II in FIG. 4, which attracting force is to be exerted on the plunger 44 when the plunger 44 is initially moved from the neutral position.

More specifically, if an attracting force indicated by the solid line III in FIG. 4 can be exerted on the plunger 44 before the plunger 44 reaches a position the distance dx before the uppermost position and the lowermost position, the plunger 44 and thus the valve body 32 can be moved between the uppermost position and the lowermost position after the plunger 44 has initially reached either the uppermost position or the lowermost position by means of the attracting force indicated by the solid line II in FIG. 4. Accordingly, it is preferable to generate two different attracting forces, one corresponding to the solid line II and the other corresponding to the solid line III, by means of the first and second solenoids 46 and 48. This is achieved by applying two different levels of voltage to the first and second solenoids 46 and 48.

It should be noted that the valve body 32 is maintained for a predetermined period at its open position and its closed position because the electromagnetic valve apparatus associated with the present embodiment is a suction or exhaust valve. In order to maintain the plunger 44 at the uppermost position or at the lowermost position, a further small attracting force is sufficient as indicated by a solid line IV in FIG. 4. Accordingly, if the level of the voltage supplied to the first and second solenoids 46 and 48 can be changed to a lower level while the valve body 32 is maintained to be at the open position or the closed position, a power consumption by the two solenoids may be further reduced.

In the above-mentioned valve driving apparatus shown in FIG. 2, when the first switch 16 is closed and the second switch 18 is opened, the first battery 10 and the second battery 14 are connected in series to the electromagnetic linear actuator 30, and thus a voltage of 24 V is applied to the electromagnetic linear actuator 30. On the other hand, when the first switch 16 is opened and the second switch 18 is closed, only the first battery 10 is connected to the electromagnetic linear actuator 30, and thus a voltage of 12 V is applied to the electromagnetic linear actuator 30.

As mentioned above, according to the present embodiment of the valve driving apparatus, a driving voltage of the electromagnetic linear actuator can be switched to either 12 V or 24 V without using a DC-DC converter. Accordingly, if the voltage is appropriately switched according to an operating condition of the internal combustion engine, the electromagnetic linear actuator 30 can be operated at a reduced power consumption with good responsiveness.

It should be noted that the first and second switches 16 and 18 correspond to the power source switching means M4. Additionally, in this embodiment, although the lower voltage is supplied by the first battery 10, the lower voltage may be supplied by the second battery 14 instead of the first battery 10.

A description will now be given of a process for switching a connection of the batteries which process is performed in the present embodiment. This process for switching may be controlled by a computer used for controlling the 12-V system 12 provided in the internal combustion engine.

Figure 5:
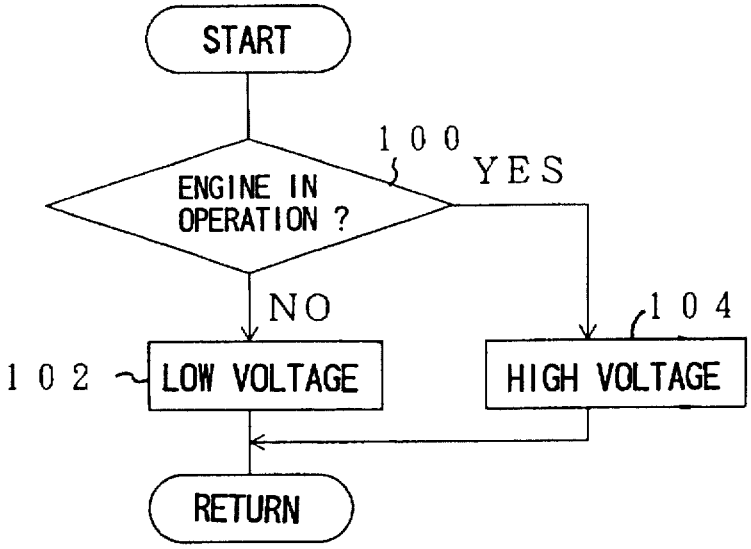
FIG. 5 is a flowchart of an example of a process for switching a voltage supplied to an electromagnetic linear actuator used in a valve driving apparatus.

FIG. 5 is a flowchart of an example of a process for switching the voltage supplied to the electromagnetic linear actuator in accordance with whether the internal combustion engine is in operation. In step 100, it is determined whether the internal combustion engine is in operation. If it is determined that the internal combustion engine is not in operation, the routine proceeds to step 102 in which the first switch 16 is turned off and the second switch 18 is turned on so that the lower voltage of 12 V is applied to the electromagnetic linear actuator 30. If it is determined in step 100 that the internal combustion engine is in operation, the routine proceeds to step 104 in which the first switch 16 is turned on and the second switch 18 is turned off so that the higher voltage of 24 V is applied to the electromagnetic linear actuator 30.

Figure 6:
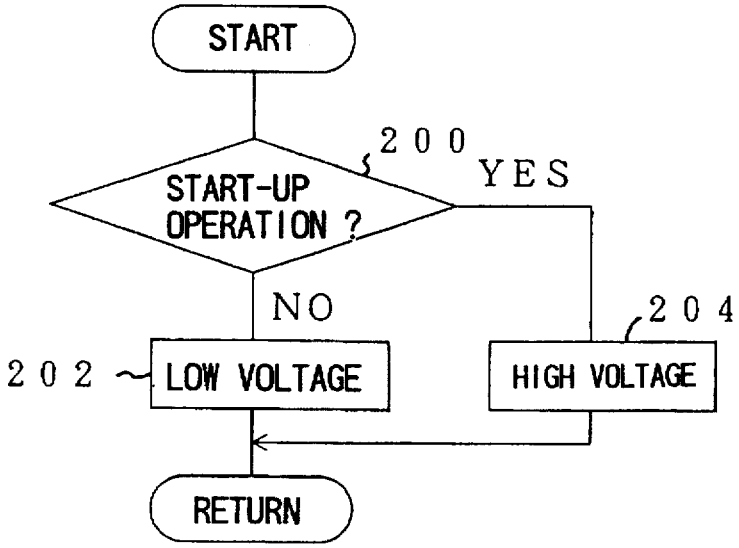
FIG. 6 is a flowchart of another example of a process for switching a voltage supplied to an electromagnetic linear actuator used in a valve driving apparatus.

FIG. 6 is a flowchart of an example of a process for switching the voltage supplied to the electromagnetic linear actuator in accordance with whether the internal combustion engine is in a start-up operation. That is, this example is based on whether the plunger 44 is initially being moved from the neutral position. In step 200, it is determined whether the internal combustion engine is in the start-up operation. If it is determined that the internal combustion engine is not in the start-up operation, that is, if it is determined that the internal combustion engine has already been started and the lower voltage is sufficient for maintaining an operation of the electromagnetic valve apparatus, the routine proceeds to step 202 in which the first switch 16 is turned off and the second switch 18 is turned on so that the lower voltage of 12 V is applied to the electromagnetic linear actuator 30. If it is determined in step 200 that the internal combustion engine is in start-up operation and a higher voltage is required for operating the electromagnetic valve apparatus, the routine proceeds to step 204 in which the first switch 16 is turned on and the second switch 18 is turned off so that the higher voltage of 24 V is applied to the electromagnetic linear actuator 30.

This process is applied for switching the attracting force characteristic from that indicated by the solid line II to that indicated by the solid line III in FIG. 4. By performing this process, good responsiveness of the electromagnetic valve apparatus is achieved while a power consumption after the internal combustion engine is started is reduced.

Figure 7:
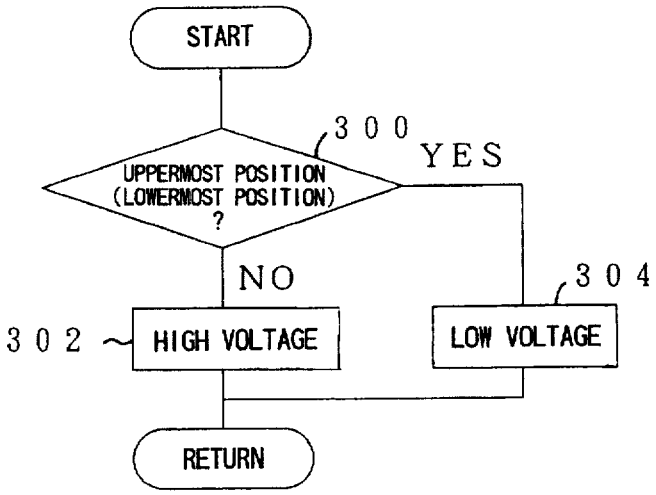
FIG. 7 is a flowchart of another example of a process for switching a voltage supplied to an electromagnetic linear actuator used in a valve driving apparatus.

FIG. 7 is a flowchart of an example of a process for switching the voltage supplied to the electromagnetic linear actuator in accordance with whether the plunger 44 is at the uppermost position or the lowermost position. That is, switching of the voltage is performed according to whether the valve body is at an end of its stroke because the valve body 32 is fixed to the plunger 44 and thus moves together with the plunger 44. In step 300, it is determined whether the plunger 44 is at the uppermost position or the lowermost position. If it is determined that the plunger 44 is not positioned at the uppermost position or the lowermost position, the routine proceeds to step 302 in which the lower voltage is applied to the electromagnetic linear actuator 30. If it is determined, in step 300, that the plunger 44 is positioned at the uppermost position or the lowermost position, the routine proceeds to step 304 in which the higher voltage is applied to the electromagnetic linear actuator 30.

This process is applied for switching the attracting force characteristic from that indicated by the solid line III to that indicated by the solid line IV in FIG. 4. By performing this process, power consumed by the electromagnetic linear actuator while the electromagnetic valve apparatus is in the open and closed states is reduced.

A description will now be given of a charging process for the first battery 10 and the second battery 14.

The first battery 10 serves as a power source for the electromagnetic linear actuator 30 as well as other electrical parts provided in the internal combustion engine. On the other hand, the second battery 14 is exclusively used for the electromagnetic linear actuator 30, and thus no load other than the electromagnetic linear actuator 30 is connected thereto. Accordingly, the second battery discharges less power per unit time than the first battery, and thus a sufficiently charged state can be maintained without performing frequent charges. Therefore, in the present embodiment, electric power generated by the alternator 22, which is originally provided for charging the first battery 10, is supplied to the second battery 14, if necessary. Thus, the two batteries can be maintained in an appropriately charged condition without providing an additional alternator.

The alternator 22 generates electric power to supply it to the first battery 10 so that an electric power discharged from the first battery 10 to be used by various electrical parts can be recharged, and thus a voltage slightly higher than 12 V is always generated by the alternator 22.

With reference to FIG. 2, if the third switch 20 is opened and the fourth switch 24 is closed, and the fifth switch 26 is switched to a contact **26*b* side (this condition is referred to as a first mode), a charge current flows to the first battery 10. On the other hand, if the third switch 20 is closed and the fourth switch 24 is opened, and the fifth switch 26 is switched to a contact 26*a* side (this condition is referred to as a second mode), a charge current flows to the second battery 14. In this embodiment, the first battery 10 is regularly charged in the first mode, and the second battery 14** is charged, only if it is necessary due to a reduction in a charged amount, by temporary switching to the second mode.

It should be noted that when switching between the first mode and the second mode, it is necessary to avoid a condition in which 24 V is applied to the alternator 22. This can be achieved by switching the fifth switch 26 to a neutral position first and thereafter operating other switches.

A charge level of the second battery 14 can be determined by measuring a voltage across the terminals thereof, or by measuring a sum of current input thereto and output therefrom. Additionally, since the second battery 14 is exclusively used for the electromagnetic linear actuator 30, the charged level can be assumed according to a number of operations of the electromagnetic linear actuator 30, that is, an accumulated number of rotations of the internal combustion engine.

Figure 8:
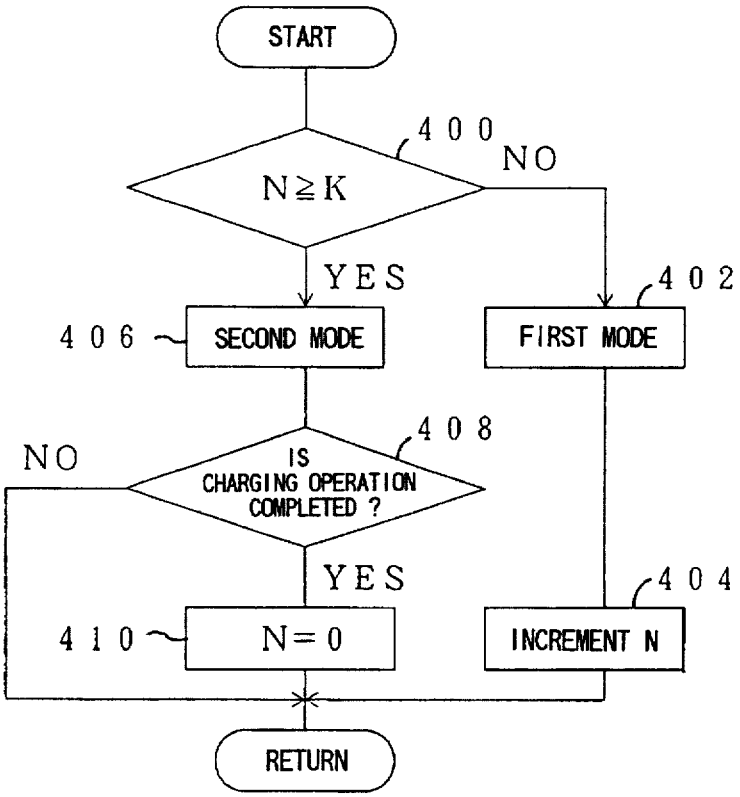
FIG. 8 is a flowchart of a process for switching a connection of an alternator to electric power sources shown in FIG. 2.

FIG. 8 is a flowchart of a process for switching a connection of the alternator 22 to the first and second batteries 10 and 14. The process shown in FIG. 8 corresponds to the power source switching means M6 shown in FIG. 1.

In the routine shown in FIG. 8, it is determined, in step 400, whether an accumulated number N of rotations of the internal combustion engine is equal to or greater than a predetermined value K. If it is determined that N is not equal to or greater than K, the routine proceeds to step 402 in which the first mode is set. The routine then proceeds to step 404 to increment N, and then the routine is ended because it is assumed that the second battery is still in a sufficiently charged level as N has not reached K.

On the other hand, if it is determined in step 400 that N is equal to or greater than K, it is assumed that the charge in the second battery 14 has been considerably consumed, and thus the routine proceeds to step 406 in which the second mode is set to charge the second battery 14. Thereafter, it is determined, in step 408, whether a charging operation for the second battery 14 is completed. A determination of a completion of the charging operation may be made according to an elapsed time since the charging operation was started, or determining the voltage across the terminals of the second battery 14.

If it is determined in step 408 that the charging operation is completed, the routine proceeds to step 410 in which N is cleared to 0, and the routine is ended. If it is determined that the charging operation is not completed, the routine is ended by skipping step 410. Accordingly, the first mode is set immediately after the charging operation for the second battery 14 is completed, and thus a charging operation for the first battery 10 is performed again. This process is repeatedly performed so that each of the first battery 10 and the second battery 14 is maintained in a sufficiently charged condition.

The present invention is not limited to the specifically disclosed embodiments, and variations and modifications may be made without departing from the scope of the present invention.

What is claimed is:

1. A valve driving apparatus for driving an electromagnetic intake or exhaust valve provided for a combustion chamber in an internal combustion engine, said internal combustion engine having a first electric power source for driving electrical devices provided therein and an alternator for supplying an electric current to said first electric power source, said valve driving apparatus comprising:

an electromagnetic linear actuator for reciprocating a valve body of said electromagnetic intake or exhaust valve so as to open or close said intake or exhaust electromagnetic valve;

a second electric power source separately provided from said first power source; and power source switching means for switching a voltage supplied to said electromagnetic linear actuator between a high voltage and a low voltage, said high voltage being generated by connecting said first electric power source and said second electric power source in series, and said low voltage being generated by either one of said first electric power source and said second electric power source.

2. The valve driving apparatus as claimed in claim 1, wherein said first electric power source comprises a first battery and said second electric power source comprises a second battery, a negative electrode of said first battery being grounded and a positive electrode of said first battery being connected to a negative electrode of said second battery.

3. The valve driving apparatus as claimed in claim 2, wherein said power source switching means comprises a first switch and a second switch, said first switch being provided between a positive terminal of said electromagnetic linear actuator and a positive electrode of said second battery, said second switch being provided between said positive terminal of said electromagnetic linear actuator and said positive electrode of said first battery.

4. The valve driving apparatus as claimed in claim 3, wherein each of said first battery and said second battery comprises a 12-V rechargeable battery.

5. The valve driving apparatus as claimed in claim 1, further comprising:

charge switching means for selectively switching a connection of said alternator to either one of said first electric power source and said second electric power source so that an electric current generated by said alternator is alternately supplied to said first electric power source and said second electric power source.

6. The valve driving apparatus as claimed in claimed in claim 5, wherein said charge switching means comprises means for switching said connection of said alternator from said first electric power source to said second electric power source each time when an accumulated number of rotations of said internal combustion engine reaches a predetermined value.

7. The valve driving apparatus as claimed in claim 5, wherein said first electric power source comprises a first battery and said second electric power source comprises a second battery, a negative electrode of said first battery being grounded and a positive electrode of said first battery being connected to a negative electrode of said second battery.

8. The valve driving apparatus as claimed in claim 7, wherein said power source switching means comprises a first switch and a second switch, said first switch being provided between a positive terminal of said electromagnetic linear actuator and a positive electrode of said second battery, said second switch being provided between said positive terminal of said electromagnetic linear actuator and said positive electrode of said first battery.

9. The valve driving apparatus as claimed in claim 8, wherein said charge switching means comprises a third switch, a fourth switch and a fifth switch, said third switch being provided between a positive terminal of said alternator and said positive electrode of said second battery, said fourth switch being provided between said positive terminal of said alternator and said positive electrode of said first battery, said fifth switch having a first contact connected to said negative electrode of said second battery and a second contact connected to said negative electrode of said first battery, said fifth switch connecting a negative terminal of said alternator to either one of said first contact and said second contact.

10. The valve driving apparatus as claimed in claim 9, wherein said fifth switch has a neutral position in which said negative terminal of said alternator is connected to neither of said first contact and said second contact.

11. The valve driving apparatus as claimed in claim 1, wherein said power source switching means comprises means for switching between said high voltage and said low voltage in accordance with a determination whether said internal combustion engine is in operation.

12. The valve driving apparatus as claimed in claim 1, wherein said power source switching means comprises means for switching between said high voltage and said low voltage in accordance with a determination whether said internal combustion engine is in a start-up operation.

13. The valve driving apparatus as claimed in claim 1, wherein said power source switching means comprises means for switching between said high voltage and said low voltage in accordance with a determination whether said valve body is at an end of a stroke.

14. A valve driving apparatus for driving an electromagnetic intake or exhaust valve provided for a combustion chamber in an internal combustion engine, said internal combustion engine having a first electric power source for driving electrical devices provided therein and an alternator for supplying an electric current to said first electric power source, said valve driving apparatus comprising:

an electromagnetic linear actuator for reciprocating a valve body of said electromagnetic intake or exhaust valve so as to open or close said electromagnetic intake or exhaust valve;

a second electric power source separately provided from said first power source; and a power source switch unit electrically connected to said electromagnetic linear actuator, said first electric power source, and said second electric power source, wherein said power source switch unit switches a voltage supplied to said electromagnetic linear actuator between a high voltage and a low voltage, said high voltage being generated by connecting said first electric power source and said second electric power source in series, and said low voltage being generated by either one of said first electric power source and said second electric power source.

15. The valve driving apparatus as claimed in claim 14, wherein said first electric power source comprises a first battery and said second electric power source comprises a second battery, a negative electrode of said first battery being grounded and a positive electrode of said first battery being connected to a negative electrode of said second battery.

16. The valve driving apparatus as claimed in claim 15, wherein said power source switch unit comprises a first switch and a second switch, said first switch being provided between a positive terminal of said electromagnetic linear actuator and a positive electrode of said second battery, said second switch being provided between said positive terminal of said electromagnetic linear actuator and said positive electrode of said first battery.

17. The valve driving apparatus as claimed in claim 16, wherein each of said first battery and said second battery comprises a 12-V rechargeable battery.

18. The valve driving apparatus as claimed in claim 14, further comprising:

a charge switch unit electrically connected to said alternator, said first electric power source, and said second electric power source, wherein said charge switch unit switches the voltage supplied from said alternator to either one of said first electric power source and said second electric power source so that an electric current generated by said alternator is alternately supplied to said first electric power source and said second electric power source.

19. The valve driving apparatus as claimed in claim 18, wherein said charge switch unit switches said connection of said alternator from said first electric power source to said second electric power source each time when an accumulated number of rotations of said internal combustion engine reaches a predetermined value.

20. The valve driving apparatus as claimed in claim 18, wherein said first electric power source comprises a first battery and said second electric power source comprises a second battery, a negative electrode of said first battery being grounded and a positive electrode of said first battery being connected to a negative electrode of said second battery.

21. The valve driving apparatus as claimed in claim 20, wherein said power switch unit comprises a first switch and a second switch, said first switch being provided between a positive terminal of said electromagnetic linear actuator and a positive electrode of said second battery, said second switch being provided between said positive terminal of said electromagnetic linear actuator and said positive electrode of said first battery.

22. The valve driving apparatus as claimed in claim 21, wherein said charge switch unit comprises a third switch, a fourth switch and a fifth switch, said third switch being provided between a positive terminal of said alternator and said positive electrode of said second battery, said fourth switch being provided between said positive terminal of said alternator and said positive electrode of said first battery, said fifth switch having a first contact connected to said negative electrode of said second battery and a second contact connected to said negative electrode of said first battery, said fifth switch connecting a negative terminal of said alternator to either one of said first contact and said second contact.

23. The valve driving apparatus as claimed in claim 22, wherein said fifth switch has a neutral position in which said negative terminal of said alternator is connected to neither of said first contact and said second contact.

24. The valve driving apparatus as claimed in claim 14, wherein said power source switch unit switches between a high voltage and said low voltage in accordance with a determination whether said internal combustion engine is in operation.

25. The valve driving apparatus as claimed in claim 14, wherein said power source switch unit switches between said high voltage and said low voltage in accordance with a determination whether said internal combustion engine is in a start-up operation.

26. The valve driving apparatus as claimed in claim 14, wherein said power source switch unit switches between said high voltage and said low voltage in accordance with a determination whether said valve body is at an end of a stroke.

* * * * *

UNITED STATES PATENT AND TRADEMARK OFFICE

CERTIFICATE OF CORRECTION

PATENT NO. : 5,537,960

DATED : July 23, 1996

INVENTOR(S) : Takashi IZUO, et al.

It is certified that error appears in the above-indentified patent and that said Letters Patent is hereby corrected as shown below:

Column 1, line 39, change "is" to --being--.

Column 4, line 60, change "vale" to --valve--.

Column 6, line 5, change "the energy" to --an energy--

Column 6, line 6, delete "lost," at beginning of line, change "an energy" to --the energy--, change "loss" to --lost,--

Column 7, line 46, delete "a" before "power".

Column 10, line 9, delete the second "claimed in" at end of line.

Signed and Sealed this

Twenty-fifth Day of February, 19

*Attest:*

*Attesting Officer*

BRUCE LEHMAN

*Commissioner of Patents and Trademarks*